US007726445B2

(12) United States Patent
Parnell

(10) Patent No.: US 7,726,445 B2
(45) Date of Patent: Jun. 1, 2010

(54) PUMP-JACK SCAFFOLD STABILIZER

(76) Inventor: Kevin Livingstone Parnell, 5819 NE. Minder, Poulsbo, WA (US) 98370

( * ) Notice: Subject to any disclaimer, the term of this patent is extended or adjusted under 35 U.S.C. 154(b) by 694 days.

(21) Appl. No.: 11/299,320

(22) Filed: Dec. 9, 2005

(65) Prior Publication Data

US 2006/0151242 A1 Jul. 13, 2006

Related U.S. Application Data

(60) Provisional application No. 60/634,836, filed on Dec. 10, 2004.

(51) Int. Cl.
*E04G 3/00* (2006.01)

(52) U.S. Cl. ..... 182/82; 182/229

(58) Field of Classification Search ..... 182/82, 182/107, 214, 229, 45
See application file for complete search history.

(56) References Cited

U.S. PATENT DOCUMENTS 2,803,388 A * 8/1957 Ross ..... 182/206
3,026,963 A * 3/1962 Wilkie ..... 182/93
3,120,878 A * 2/1964 Neeley ..... 182/82
3,210,036 A * 10/1965 Owens ..... 248/237
3,292,734 A * 12/1966 Swanberg ..... 182/45
4,326,703 A * 4/1982 Marley ..... 269/156
4,527,763 A * 7/1985 Woytowich ..... 248/238
4,957,185 A * 9/1990 Courchesne et al. ..... 182/150
5,307,899 A 5/1994 Lubinski ..... 182/136
5,775,465 A * 7/1998 Vossler ..... 182/214

* cited by examiner

*Primary Examiner*—Alvin C Chin-Shue
(74) *Attorney, Agent, or Firm*—Seed IP Law Group PLLC

(57) ABSTRACT

A stabilizer for bracing a pump-jack scaffold to a roof is provided that includes an arm having a plurality of slots for engaging and disengaging one or more anchor points on a roof and a base or foot coupled to the arm for relative movement with respect to the arm and engagement with a scaffold post and with the roof. The slotted arm permits engagement and disengagement with fasteners in the roof without requiring removal of the fasteners from the roof.

8 Claims, 5 Drawing Sheets

PUMP-JACK SCAFFOLD STABILIZER

BACKGROUND OF THE INVENTION

1. Field of the Invention

The present invention pertains to devices for stabilizing temporary supports, such as scaffolds, and, more particularly, to a brace for securing a portable scaffold support post to a roof, wall, or similar structure.

2. Description of the Related Art

Builders and remodelers utilize portable support structures, such as scaffolds, to hold workers, tools, and supplies at elevated levels. Scaffolding is a popular apparatus used to provide a temporary elevated platform on a supporting framework because it can be constructed of easily portable and assembled components, including footings, poles, legs, frames, posts, platforms, and uprights. Pump-jack scaffolds have an additional feature of a platform that is raised and lowered via a pump jack mounted on the uprights.

FIG. 1 illustrates a known pump-jack scaffold 10 adjacent to an existing residential house 12. Generally, a pump-jack frame 14 consists of only two upright support posts 16 that utilize the house 12 for support. More particularly, while cross-bracing 18 provides some rigidity for the framework 14, it will not prevent the scaffold 10 from falling away from the building 12. Thus, roof braces 20 are used to secure the scaffold 10 to the house 12.

As shown in FIG. 1, the roof braces 20 include an elongate tubular brace 22 attached to the roof 24 via a roof plate 26. This maintains the framework 14 in a fixed position relative to the roof 24, providing some means of safety for workers who stand on a platform 28 that is moveably mounted on the uprights 16 by pump-jacks 30.

One of the drawbacks of current bracing methods is the use of multiple components that can be separated from each other during disassembly and transport. In addition, disconnected or removable parts can easily fall during installation. Moreover, in many applications workers nail plywood or wood braces to the roof and to the scaffold, which can damage the roof upon removal. In addition, current methods of bracing require substantial labor to assemble the bracing materials and attach them to the roof and the scaffolding, resulting in inefficient use of labor.

The U.S. Department of Labor—Occupational Safety and Health Administration (OSHA) has promulgated scaffold specifications set forth in 29 C.F.R. §1926.452(j)(2), which requires that "poles shall be secured to the structure by rigid triangular bracing or equivalent at the bottom, top, and other points as necessary." In addition, the OSHA regulations require that the scaffolding be within 14 inches of the building structure. Hence, there is a need for a device that can brace a pump-jack scaffold support to the roof of a building or similar structure, has no removable parts, can accommodate different pitches and slopes of roofs in different directions, is easily and quickly attached or mounted to the scaffold, can accommodate different support post sizes, and can be removed without damaging the roof or increasing the risk of injury to users or those nearby.

BRIEF SUMMARY OF THE INVENTION

The disclosed embodiments of the present invention are directed to a device for stabilizing a scaffold by bracing one or more of the scaffold posts to an existing roof of a building structure without compromising the integrity of the roof structure and facilitating quick and safe engagement and disengagement of the stabilizer with the roof and with the scaffold posts.

In accordance with one embodiment of the invention, a stabilizer is provided that includes a first attachment member configured to engage with and disengage from a first attachment point on the roof, and a second attachment member configured for removable attachment to the scaffold pole.

In accordance with another embodiment of the invention, a device is provided that includes a first member having openings therein to enable the first member to attach to and detach from an anchor; and a second member coupled to the first member to enable relative movement between the first member and the second member, the second member adapted for removable mounting to a scaffold post or upright.

In accordance with another embodiment of the invention, a scaffold system is provided that includes a scaffold having at least one pole for supporting the scaffold on the ground; and a stabilizer for bracing the pole with respect to the roof on the building structure, the stabilizer comprising: a first attachment member configured to engage with and disengage from at least one anchor point on the roof; and a second attachment member configured for removable mounting on the pole of the scaffold.

BRIEF DESCRIPTION OF THE SEVERAL VIEWS OF THE DRAWINGS

The foregoing advantages and features of the present invention will be more readily appreciated as the same become better understood from the following detailed description when taken in conjunction with the accompanying drawings, wherein.

DETAILED DESCRIPTION OF THE INVENTION

Figure 1:
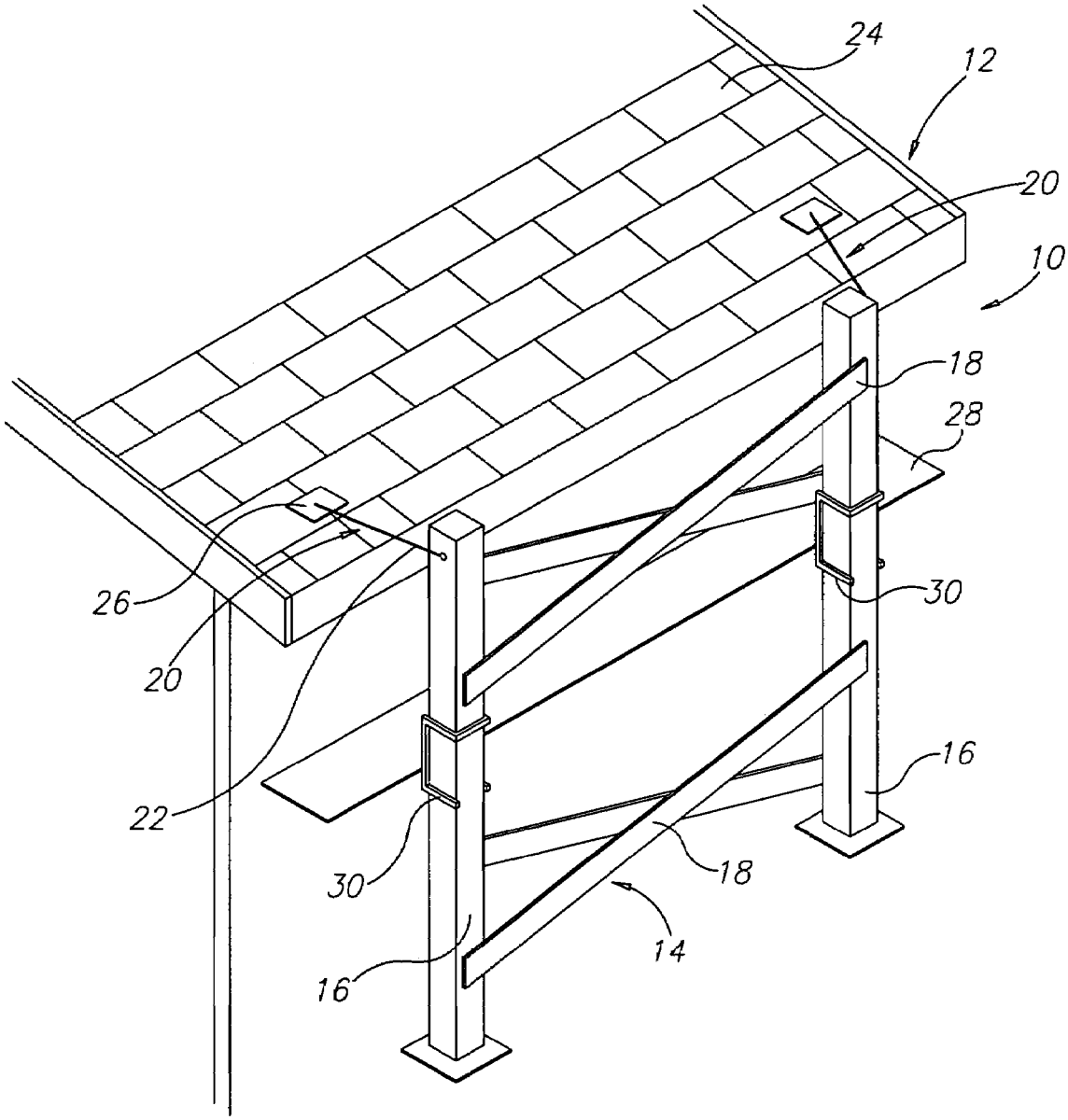
FIG. 1 is an isometric view of a conventional pump-jack scaffold used in conjunction with a residential building.
Figure 2:
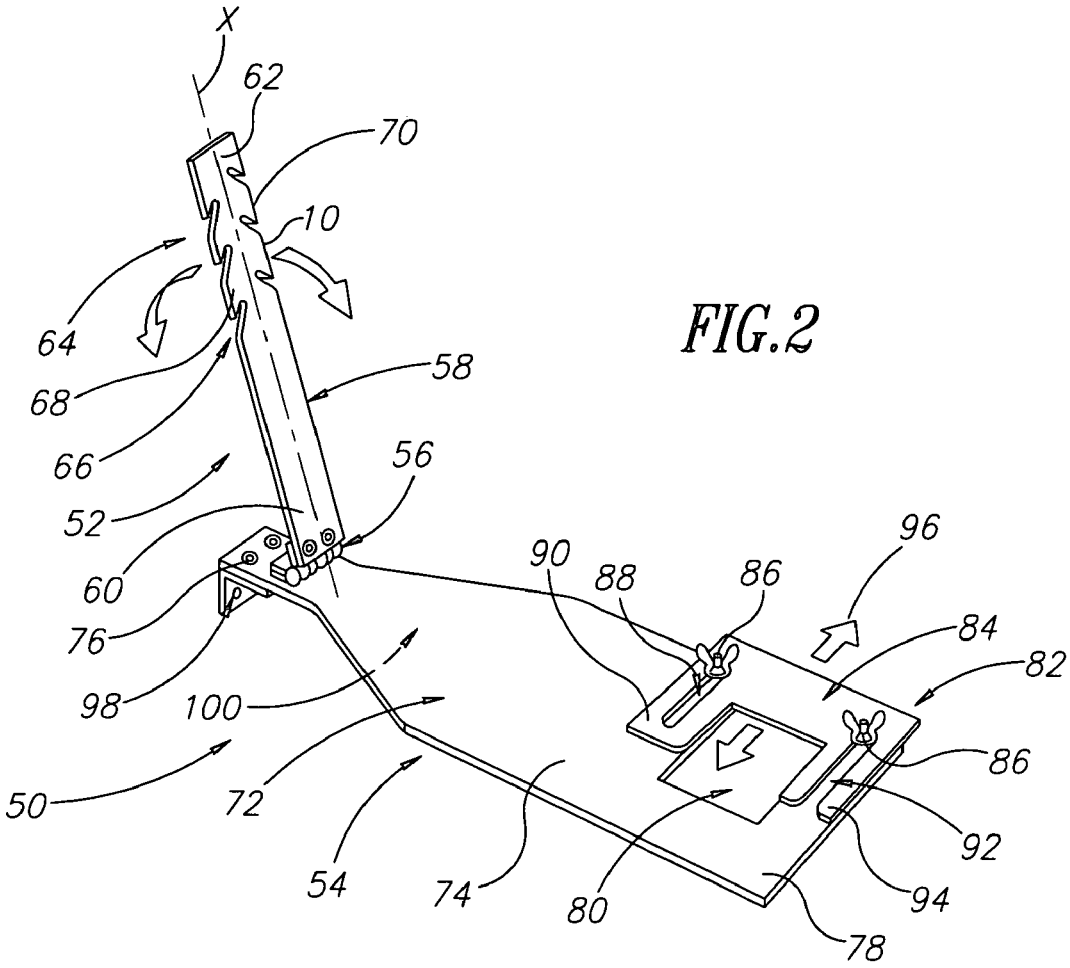
FIG. 2 is an isometric view of a pump-jack scaffold stabilizer formed in accordance with the present invention.

Referring initially to FIG. 2, shown therein a stabilizer 50 formed in accordance with one embodiment of the present invention. The stabilizer 50 as shown here includes a first attachment member 52 and a second attachment member 54. Ideally, the first attachment member 52 is coupled to the second attachment member 54 in a manner that prevents relative movement between the first attachment member 52 and the second attachment member 54. However, it is to be understood that in certain embodiments of the invention, a rigid coupling can be used or the first attachment member 52 can be integrally formed with the second attachment member 54. In this embodiment, the first attachment member is hingedly attached to the second attachment member 54 by a hinge mechanism 56. It is to be understood that "attachment" as used herein can include fixed attachment, attachment or coupling to enable relative movement between components, and removable attachment, unless otherwise described herein.

Ideally, the first attachment member 52 includes an elongate arm 58 having a first end 60 attached to the hinge mechanism 56 and a second end 62 with a plurality of engaging means 64 formed thereon. In a preferred embodiment, the engaging means 64 comprise a plurality of openings. While the openings can be in the form of holes, in a preferred embodiment slots 66 are formed on a first side 68 and a second side 70 of the elongate arm 58. Preferably, the slots 66 open to their respective sides 68, 70 to facilitate slideable engagement with and disengagement from one or more anchor points, as will be described in more detail hereinbelow.

Preferably, each slot 66 is elongate and has its longitudinal axis oriented at an angle with respect to a longitudinal axis X of the first attachment member 52. While the angle can vary from 90° or perpendicular with respect to the longitudinal axis X, preferably the angle of the elongate slots 66 is an acute angle in the range of 30° to 60° such that the slots angle away from the first attachment member 54 as shown in FIG. 2. As shown therein, the slots 66 on the first side 68 are offset longitudinally from the slots 66 on the second side 70 of the arm 58.

The second attachment member 54 includes a foot 72 having a first surface 74 on which is mounted the hinge mechanism 56. Ideally, the hinge mechanism 56 is affixed to the top surface 74 at a first end 76 of the foot 72 while a second end 78 of the foot 72 has an opening 80 formed therein. Ideally, the opening 80 is enclosed on three sides by the structure of the foot 72 and has a fourth side that is open to permit slideable engagement with a post member, as will be described in more detail hereinbelow. The opening 80 can be adjusted in dimension via a slide mechanism 82 in the form of a slide plate 84 slideably mounted on the foot 72 via fasteners 86. Preferably the fasteners 86—in this case bolts and wing nuts—permit quick and easy adjustment in the mounting and adjustment in the placement of the slide plate 84 while firmly attaching the same to the foot 72.

In a preferred embodiment, the slide plate 84 has a U-shaped configuration in which a closed slot 88 is formed in a first leg 90 and an opened slot 92 is formed in a second leg 94. The fasteners 86 projecting through the slots 88, 92 can be loosened to enable sliding of the slide plate 84 as shown by the arrows 96. In addition, the slide plate 84 can swing away from the foot 72 by sliding it away from the plate 72 so that the open slot 92 disengages from the fastener 86 and the slide plate 84 rotates around the fastener 86 in the enclosed slot 88. This facilitates the slideable engagement of the second attachment member 54 with a scaffold post, as shown in FIG. 3.

Another feature of the second attachment member 54 is a flange 98 extending downward from a bottom surface 100 of the foot 72. This flange has one or more openings (not shown) to permit fasteners, such as screws or nails, to pass therethrough. It is to be understood that this flange can be formed to project upward from the top surface 74, although this is not a preferred configuration.

Ideally the flange 98 is a single piece having a first leg attached to a bottom surface of the foot 72 and a second leg formed at approximately a right angle thereto and projecting away from the foot 72. Fasteners are used to attach the flange 98 to the first end 76 of the foot 72. However, it is to be understood that the flange can be integrally formed with the foot 72, either at the angle shown or at another angle for a particular application. In addition, the flange can be adjustable in its relative angle to the foot 72 to facilitate attaching the foot 72 to a roof at other than a right angle.

Figure 3:
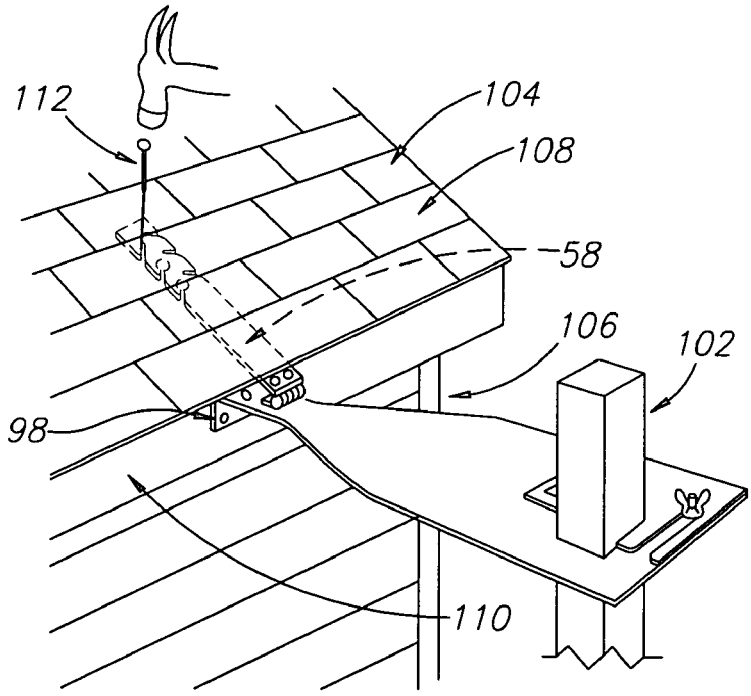
FIG. 3 is an isometric view of the pump-jack scaffold stabilizer of FIG. 2 as installed on a roof.

Referring next to FIG. 3, shown therein is the stabilizer 50 described above in FIG. 2 as used in connection with a stabilizer post 102 that is to be braced with respect to a roof 104 on an existing building structure 106. The roof 104 has a plurality of shingles 108 attached to underlying sheathing (not shown). A fascia board 110 is also shown in association with the roof 104. In this embodiment, the post 102 is a four inch by four inch upright, although a double two-by-four inch post is also commonly used. As can be seen in FIG. 3, the elongate arm 58 is anchored to the roof 104 via at least one and preferably a plurality of fasteners, in this case nails 112.

In addition, the foot 72 has the flange 98 attached to the fascia board 110 while the opening 80 is slid over the post 102 and the slide plate 84 is positioned in engagement with the post 102 and held in place by the fasteners 86, in this case the wing nuts threadably engaged with the bolts extending through the foot 72. In order to meet OSHA regulations, the opening 80 is formed relative to the flange 98 in order to position the scaffold structure at least 14 inches away from the fascia board 110. In other words, the inside edge of the opening 80 is no closer than 14 inches to the flange 98. In an alternative embodiment of the invention, the foot 72 can have an adjustable length (the distance from the first end 76 to the second end 78) to permit adjustment in the distance between the opening 80 and the flange 98 in order to accommodate unique situations.

In use, the stabilizer 50 is brought to the roof 104 with the arm 58 inserted under the existing roof shingles 108 until the flange 98 is tight against the fascia board 110. Nails 112 or other fasteners are then not driven through the shingles but instead under the shingles and the slots 66 on the left side 68 of the arm 58 only. In a worst-case scenario the nails could be driven through the roofing, which would then have to be repaired. The slots 66 enable the arm 58 to disengage from the nails 112 at a later point, which is described in more detail below. After the nails 112 are driven into the roof structure, the flange 98 is then attached to the fascia board 110, either by nails or screws. At least one of the fasteners must penetrate through the flange 98 and into either the end of a rafter tail on the fascia, into a lookout on the bargeboard at a gable end (unless a solid 2× barge is used), or into a stud when using a sidewall application.

After the foot 72 has been attached, and with the post 102 already extending through the opening 80, the slide plate 84 is then fixed in place with the fasteners 86. Alternatively, the foot 72 can be first attached to the fascia board 110, after which the arm 58 is swung into position on the roof sheathing (this step is not used in a sidewall application). When used in a fascia application as shown in FIG. 3, the arm 58 pivots to match the pitch of the roof 104 to which it is being attached. When attaching the arm 58 to the roof sheathing, the nail or fastener must pass into a truss or a rafter member. This type of attachment may be used prior to roofing with the shingles 108 or after the roofing is installed. If roofing is not installed prior to anchoring of the arm 58 in place, the roofing may be installed over the arm 58 with no hindrance to the roofer or to the roofing.

When roofing has been installed prior to installation of the arm 58, the roofing or shingles 108 must be carefully lifted and the arm 58 slid thereunder and nailed in such a fashion that when the roofing or shingles 108 are laid back down, the roofing covers the penetrations of the fasteners through the sheathing.

Once the foot 72 and the arm 58 are secured in place, the capture device in the form of the slide plate 84 and opening 80 are then used to secure the post 102 into place. It is to be understood that the post 102 must have its base (not shown in FIG. 3) securely in position for the safe use of the stabilizer. With the slide plate 84 pivoted away from the opening 80, the scaffold post 102 can be easily inserted. After insertion, the slide plate 84 is then swung back onto the foot 72 with the open slot 92 engaging the respective fastener 86, and it is pressed securely against the post 102. The wing nuts, which ideally are nonremovable wing nuts, are then used to tighten the slide plate 84 into place securely around the post 102.

In one embodiment of the invention, a non-removable thumbscrew (not shown) is provided on the underside of the foot 72 that can be tightened into engagement with the post 102 to stop any potential downward slipping of the foot 72 with respect to the post 102. The stabilizer is now in position and ready for use.

Figure 4:
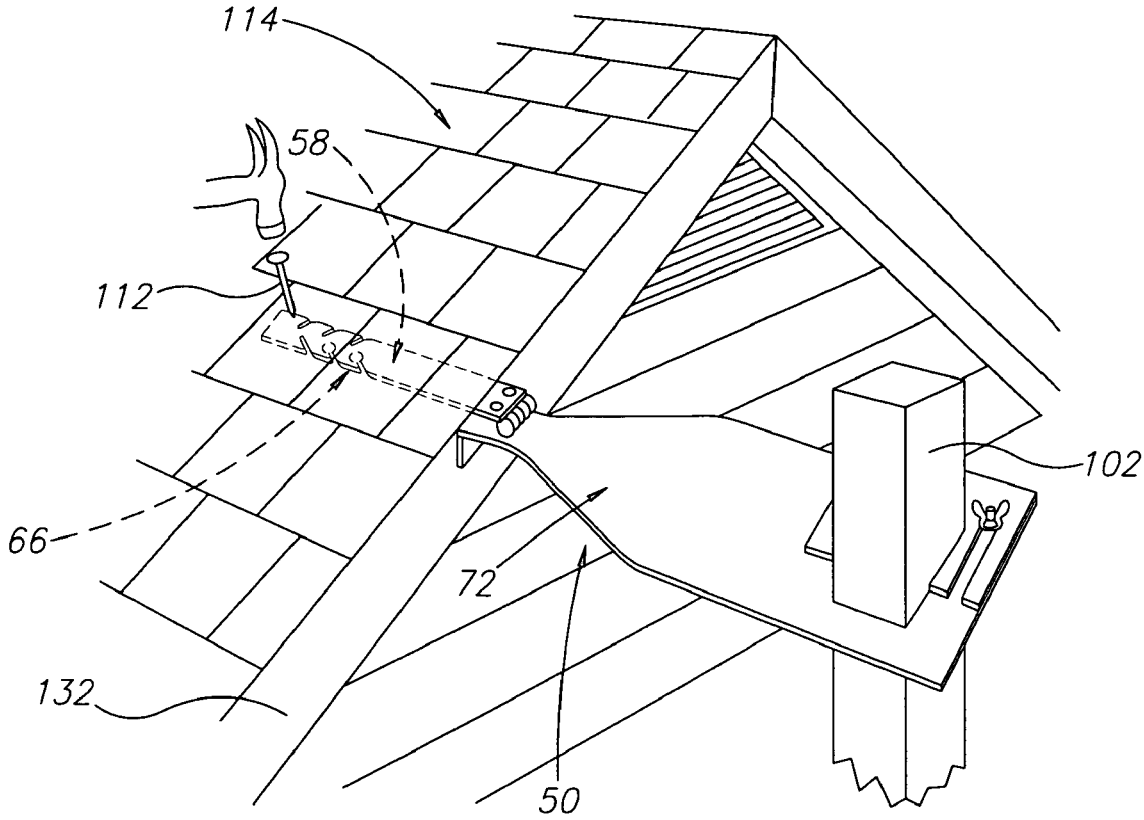
FIG. 4 is an isometric view of an alternative installation of the pump-jack scaffold stabilizer of FIG. 2.

When the stabilizer 50 is used in a gable-end application, the openings in the flange 98 are set in such a way that when attaching they do not cause damage to the small frieze or rake boards that may be used. Gable-end attachment may be used on either side of the roof pitch. As shown in FIG. 4, care must be taken to use only the downhill slots 66 in the arm 58 to assure positive connection to the roof 114. Once again, the same procedure for installation in the gable-end roof 114 is used as described above with respect to the fascia application in FIG. 3. It is to be noted that there is a gap between the arm 58 and the foot 72, which facilitates the fitting of the roof material therebetween, allowing the flange 98 to be attached to the roof 114. As can be seen in FIG. 4, the opening 80 and the slide plate 84 cooperate to accommodate multiple roof pitches.

In a sidewall application, it is noted that the installation is the same as the fascia application, except that the arm 58 will not be used.

Figure 5:
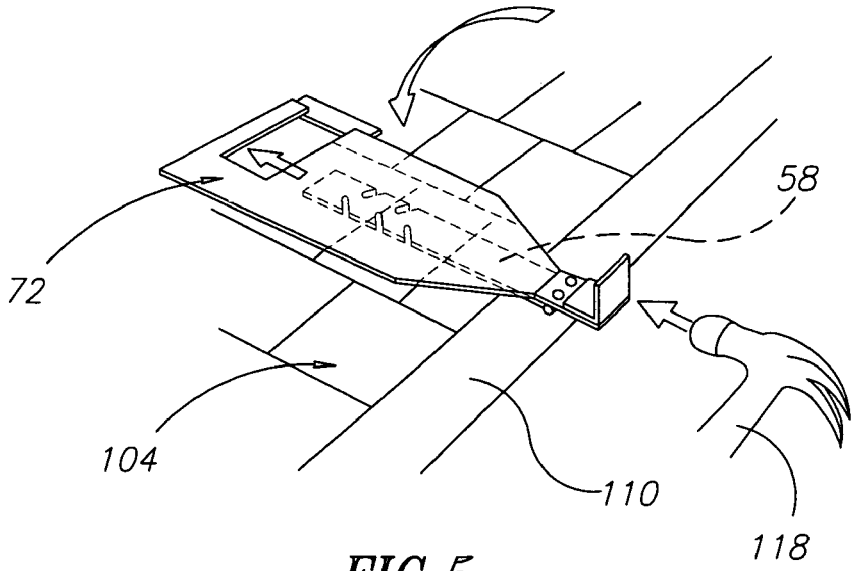
FIG. 5 is an isometric view of a removal step in disengaging the pump-jack scaffold stabilizer of FIG. 2 from a roof without damaging the roof.
Figure 6:
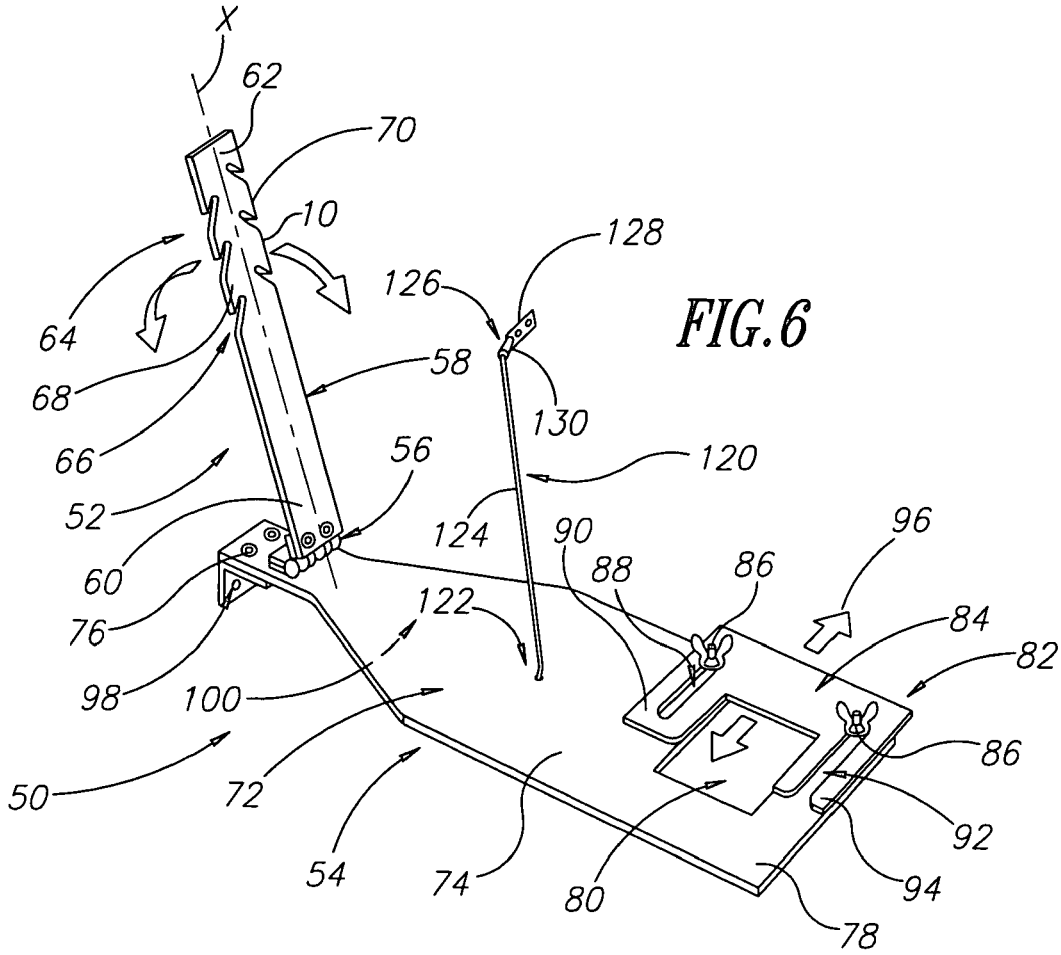
FIGS. 6-9 illustrate the stabilizer of FIGS. 2-5 formed in accordance with an alternative embodiment of the present invention.

Removal of the stabilizer 50 is essentially the reverse of installation, except for one step. The thumbscrew is loosened and the slide plate 84 is opened to remove the post, and the flange 98 is then disconnected from the fascia board 110. The foot 72 is then rotated upward and over to lie on top of the roof 104 and parallel to the arm 58 as shown in FIG. 5. A hammer 118 is then used on a back side of the flange 98 to drive the arm 58 upward and off of the nails 112 that were used to attach it to the roof sheathing. At this point, if the roofing 108 has been installed, the arm 58 simply slides further up under the roofing 108 until it is dislodged from the nails 112. The arm 58 can then be slid downward from under the roofing 108 and removed with no damage to the roofing 108.

As will be readily appreciated from the foregoing, the stabilizer 50 of the present invention is designed with no removable parts. In this way, no parts can be lost or, in a worst case scenario, dropped from a ladder or roof edge during installation. Ideally, the stabilizer 50 is constructed of durable, heavy-duty material, such as stainless steel or other metal that will not rust, for use on any job site. With the stabilizer 50, bracing the portable scaffold is now easier and safer. Unlike other braces, the stabilizer 50 of the present invention will not damage the siding or the roofing. The unique design disclosed herein makes it easy for one person to attach the stabilizer 50 quickly to any pitch roof. The heavy-duty construction provides reliability and long-lasting use of the stabilizer 50. In addition, it is foldable to store easily when not in use.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

FIGS. 6-9 illustrate an alternative embodiment of the present invention in which the stabilizer 50 is illustrated with like parts having the identical reference numbers. In this embodiment an additional feature is provided in the form of a swing arm 120 attached to the foot 72 to extend from the top surface 74. Alternatively, the swing arm 120 can be mounted to extend below the foot 72 as shown in phantom lines in FIG. 8.

The swing arm 120 is preferable mounted to the foot 72 to rotate about the foot 72. Suitable mounting means can include a carriage bolt, ball joint, or other mechanism known to those skilled in the art to permit rotation of the arm about an axis substantially perpendicular to the foot 72.

The swing arm 120 has a first end 122 that is mounted to the foot 72, an elongate extension 124 formed at preferably a 90 degree angle to the first end such that the extension 124 is parallel to the plane of the substantially planar foot 72, and a second end 126 distal to the first end 122. The second end 126 has a mounting plate 128 extending therefrom, preferably at a 45 degree angle, although other angles may be used. While the mounting plate 128 can be integrally formed with the extension 124, it is preferably adjustably mounted to the end of the extension in a manner that permits rotation of the plate 128 about a longitudinal axis of the extension 124. A ball joint may be used or a threaded adjuster 130 may be used, which is readily commercially available and will not be described in detail herein.

Figure 7:
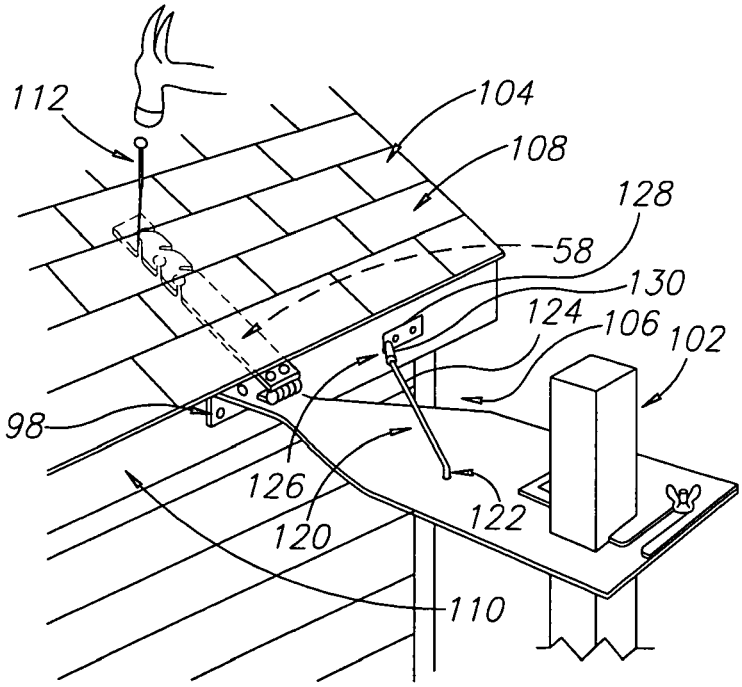
Figure 8:
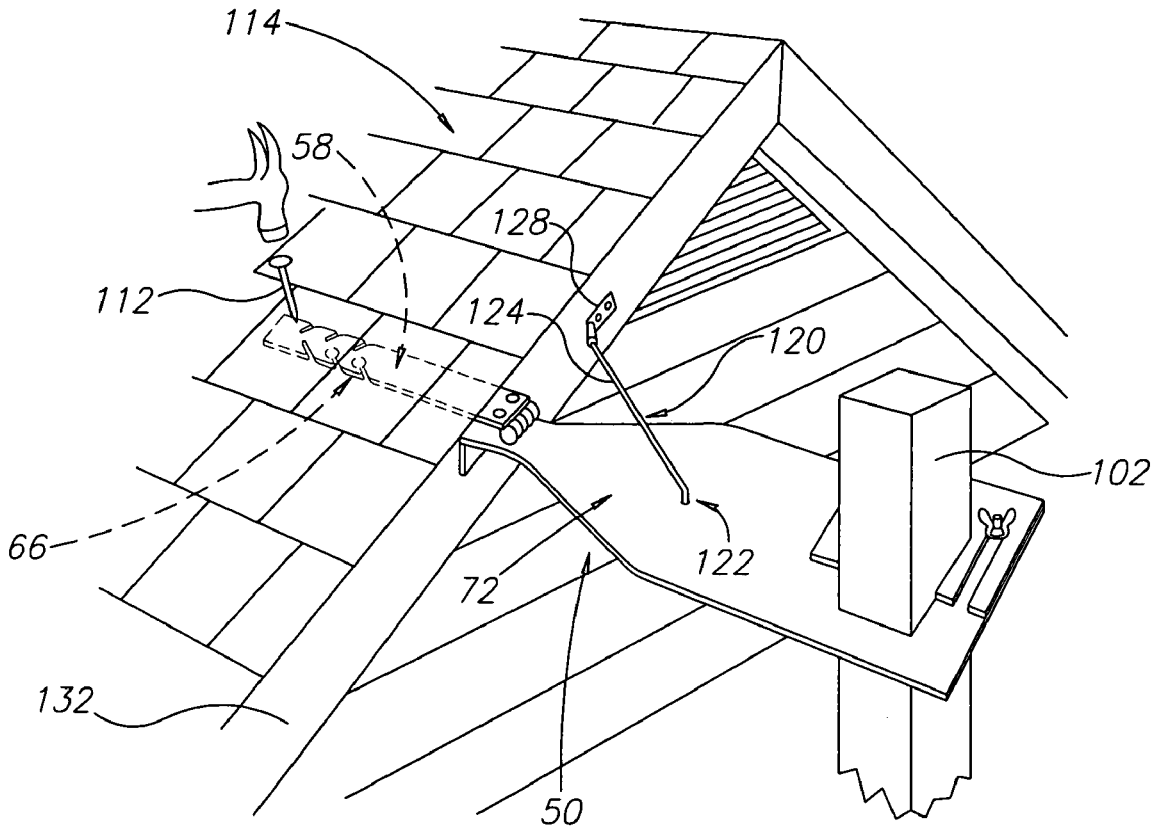
Figure 9:
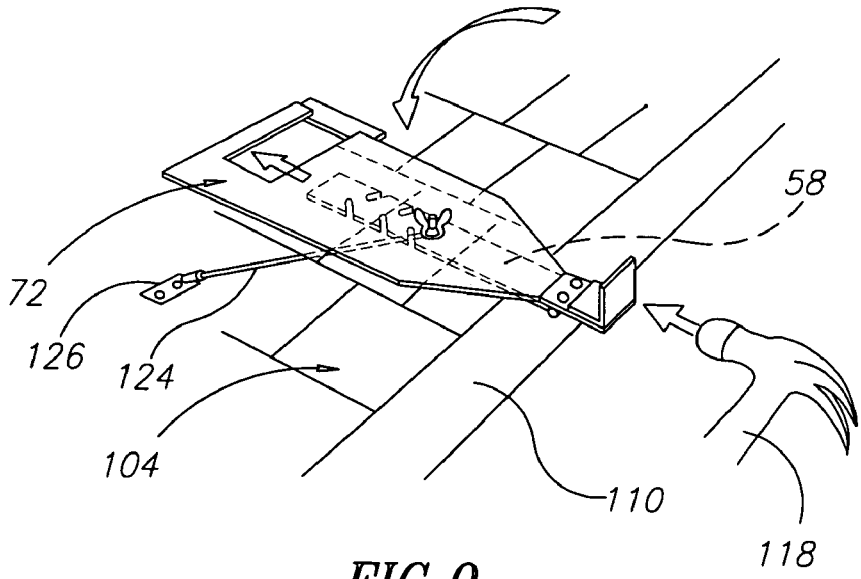

In use, the swing arm 120 is attached to the fascia board 110 or gable end 132 as shown in FIGS. 7 and 8 to provide additional stability. When used on the gable end 132, the swing arm 120 is preferably attached to the uphill side of the foot 72 with screws or nails, although it may be attached to the downhill side as shown in phantom in FIG. 8.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A stabilizer for bracing a scaffold pole to a structure the structure having first and second attachment points, the stabilizer comprising:

a first plate member having a planar configuration and comprising an opening engaging an anchor to slideably engage with and disengage from the first attachment point on the structure; and a second plate member configured for removable attachment to the scaffold pole, the second plate member having a planar configuration and hingedly attached to the first plate member to form a one-piece stabilizer in which the first plate member and second plate member pivot relative to one another to enable rotation of the second plate member so that a top surface of the second plate member is in a position on top of a top surface of the first plate member to expose a bottom surface of the second plate member, the second plate member having a opening adjacent a first end of the second plate member sized and shaped to be received over the pole, the stabilizer further comprising an attachment plate slideably mounted on the second plate member to engage the second plate member with the pole at a selected angle to the pole, the second plate member further comprising a flange extending from a second end of the second plate member adjacent the hinged attachment of the first plate member, the flange comprising an angle having a first leg fixed to the bottom surface of the second plate member and a flange leg projecting away from the bottom surface of the second plate member, said flange leg having apertures receiving fasteners for attachment to the structure and when the second plate member is in position on top of the first plate member, the flange leg projects away from the second plate member and is sized and shaped to enable hammering on the flange leg to disengage the first plate member from the first attachment point, and the attachment plate has a U-shaped configuration formed of first and second legs that are structured to be positioned on respective sides of the pole.

2. The stabilizer of claim 1 wherein the opening comprises at least one slot in the first plate member.

3. The stabilizer of claim 2, wherein the first plate member has an elongate body with a longitudinal axis, and the at least one slot is formed at an angle with respect to the longitudinal axis of the elongate body of the first plate member to facilitate engagement with and disengagement from the anchor at the first attachment point on the structure.

4. The stabilizer of claim 1, further comprising an attachment member coupled to the second plate member to move relative to the second plate member and configured for removable attachment to the second attachment point on the structure.

5. A scaffold system for use with a building structure having at least first and second attachment points, the system comprising:

a scaffold having at least one pole for supporting the scaffold; and a stabilizer for bracing the pole with respect to the structure, the stabilizer comprising:

a first plate member having a planar configuration and comprising a plurality of openings engaging at least one anchor to slideably engage with and disengage from the first attachment point on the structure; and a second plate member configured for removable attachment to the scaffold pole, the second plate member having a planar configuration and hingedly attached to the first plate member to form a one-piece stabilizer in which the first plate member and second plate member pivot relative to one another to enable rotation of the second plate member in a position on top of a top surface of the first plate member to expose a bottom surface of the second plate member, the second plate member having a opening adjacent a first end of the second plate member sized and shaped to be received over the pole and an attachment plate slideably mounted on the second plate member to engage the second plate member with the pole at a selected angle to the pole, the second plate member further comprising a flange extending from a second end of the second plate member adjacent the hinged attachment of the first plate member, the flange comprising an angle having a first leg fixed to the bottom surface of the second plate member and a flange leg projecting away from the bottom surface of the second plate member at substantially a right angle, the flange leg having apertures receiving fasteners for attachment to the second attachment point on the structure, and when the second plate member is in position on top of the first plate member the flange leg projects outward and is sized and shaped to enable hammering on the flange leg to disengage the first plate member from the first attachment point on the structure, and the attachment plate has a U-shaped configuration formed of first and second legs that are structured to be positioned on respective sides of the pole.

6. The system of claim 5 wherein the first plate member comprises an elongate body having a longitudinal axis and the plurality of openings comprise a plurality of slots formed at an angle to the longitudinal axis.

7. The system of claim 6 wherein the slots are longitudinally offset from one another on the first plate member.

8. The system of claim 5, further comprising an arm movably coupled to the second plate member and configured for removable attachment to the structure.

* * * * *